US011428399B2

(12) United States Patent
Boogaard et al.

(10) Patent No.: US 11,428,399 B2
(45) Date of Patent: Aug. 30, 2022

(54) HEAT SINK WITH DOUBLE SIDED REFERENCE PIN

(71) Applicant: Lumileds LLC, San Jose, CA (US)

(72) Inventors: Wim Boogaard, Middelburg (NL); Piet Verburg, Middelburg (NL); Pieter van der Wekken, Middelburg (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/175,188

(22) Filed: Feb. 12, 2021

(65) Prior Publication Data

US 2021/0247060 A1 Aug. 12, 2021

(30) Foreign Application Priority Data

Feb. 12, 2020 (EP) ..... 20156939

(51) Int. Cl.
*F21V 29/81* (2015.01)
*F21V 29/71* (2015.01)

(52) U.S. Cl.
CPC ..... *F21V 29/81* (2015.01); *F21V 29/713* (2015.01)

(58) Field of Classification Search
CPC ..... F21V 29/713; F21V 29/81; F21V 29/89; F21V 29/70; F21V 17/005; F21S 41/141; F21S 41/19; F21S 45/47; F21S 45/49
See application file for complete search history.

(56) References Cited

U.S. PATENT DOCUMENTS 7,527,386 B1 * 5/2009 Salinas Fox ..... G01D 11/28 362/23.18
2009/0185381 A1 * 7/2009 Willwohl ..... F21S 45/48 362/294
2009/0225554 A1 * 9/2009 Chang ..... F21V 29/51 362/373
2012/0176032 A1 * 7/2012 Chu ..... F21V 29/773 315/32
2013/0051058 A1 * 2/2013 Bako ..... F21S 45/48 362/523
2013/0063937 A1 * 3/2013 Ahn ..... F21V 19/004 362/235
2014/0009951 A1 * 1/2014 Monma ..... F21S 45/49 362/509
2017/0030547 A1 2/2017 Yasuda et al.
2017/0045194 A1 2/2017 Garcia Castilla et al.
2017/0067611 A9 3/2017 Marley et al.
(Continued)

FOREIGN PATENT DOCUMENTS

JP 2013-131313 7/2013

OTHER PUBLICATIONS

Extended European Search Report dated Jul. 27, 2020 for European Patent Application No. 20156939.9.

*Primary Examiner* — Zheng Song
(74) *Attorney, Agent, or Firm* — Volpe Koenig

(57) ABSTRACT

A heat sink, lighting device and method of manufacture are described. A heat sink includes at least one sheet metal having a first surface and a second surface, at least one first reference pin extending at least in part from the first surface, and at least one second reference pin extending at least in part from the second surface and located within a diameter of, and concentrically with, the at least one first reference pin. The diameter of the at least one first reference pin being larger than a diameter of the at least one second reference pin.

16 Claims, 4 Drawing Sheets

(56) References Cited

U.S. PATENT DOCUMENTS

| | | | | |
|---|---|---|---|---|
| 2017/0299143 | A1 | 10/2017 | Mornet | |
| 2018/0128444 | A1* | 5/2018 | Suemitsu | F21S 41/36 |
| 2019/0011101 | A1 | 1/2019 | Spinger et al. | |
| 2020/0132268 | A1* | 4/2020 | Zhang | F21S 41/663 |

* cited by examiner

HEAT SINK WITH DOUBLE SIDED REFERENCE PIN

CROSS REFERENCE TO RELATED APPLICATION

This application claims the benefit of European Patent Appln. No. 20156939.9, which is incorporated by reference as if fully set forth.

FIELD OF INVENTION

The present disclosure relates to a heat sink and a lighting device comprising such a heat sink, in particular for automotive exterior or interior lighting. The present disclosure also relates to a method for producing such a lighting device.

BACKGROUND

Modern lighting devices used as automotive exterior or interior lights may include a heat sink. A light emitting device or a lighting module, such as an LED, may be attached to the heat sink so that heat from the operation of the lighting module can safely be transferred away from the heat sink without causing damage to the lighting module. The lighting module attached to the heat sink may be coupled to an electrical interface via electrical lines so that the lighting module can be externally controlled (e.g., switched between functions and/or turned on or off).

SUMMARY

A heat sink, lighting device and method of manufacture are described. A heat sink includes at least one sheet metal having a first surface and a second surface, at least one first reference pin extending at least in part from the first surface, and at least one second reference pin extending at least in part from the second surface and located within a diameter of, and concentrically with, the at least one first reference pin. The diameter of the at least one first reference pin being larger than a diameter of the at least one second reference pin.

BRIEF DESCRIPTION OF THE DRAWINGS

Examples of the invention will now be described in detail with reference to the accompanying drawings, in which.

DETAILED DESCRIPTION OF THE PREFERRED EMBODIMENTS

Figure 1:
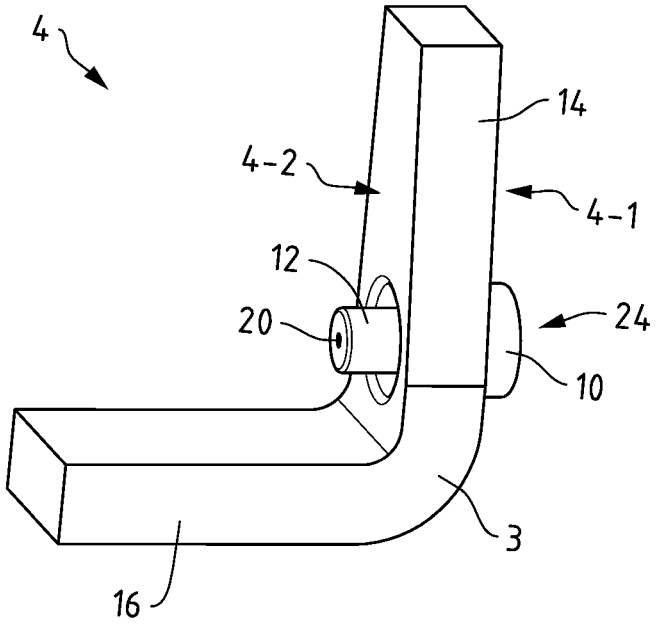
FIG. 1 is a perspective view of an example heat sink for a lighting device.

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures. It will be understood that these terms are intended to encompass different orientations of the device in addition to the orientation depicted in the figures.

Further, whether the LEDs, LED arrays, electrical components and/or electronic components are housed on one, two or more electronics boards may also depend on design constraints and/or application.

In automotive lamps, such as headlamps or back lights, heat sinks may have a form defined by the available space behind the optical element, such as a reflector or lens. For enabling multiple functions, in particular a high beam and a low beam function, sometimes multiple units may be placed next to each other, while in other cases the units may be placed on top of each other. The construction of the heat sink of such a dual function module may require a complex die-cast freeform or include a combination of multiple extruded or stamped structures that can be welded together.

To ensure that a lighting module is placed in such a way that the required emitted light, such as with respect to intensity and/or direction of emitted light, may be achieved, reference pins may be used that extend from the surface of the heat sink. Such reference pins may allow referencing of, for example, a lighting module in relation to the heat sink and/or referencing of the heat sink to an optical element, such as. a reflector of an automotive head lamp. Since such reference pins need to be mounted to the heat sink, such as by welding, it may be very difficult and costly to build such a lighting device in an accurate way, since, for example, welding is very difficult to do accurately. The price for such a die-cast freeform, or a multitude of different components, may also be high since the manufacturing is complex.

Embodiments described herein may provide for a heat sink, a lighting device, and a method of manufacturing a lighting device that may be cost effective and/or enhance manufacturing of the lighting device, preventing or at least alleviating aforementioned drawbacks and enabling accurate positioning of referencing elements of such a heat sink.

FIG. 1 is a perspective view of an example heat sink 4 for a lighting device 2. The heat sink 4 may be formed out of a sheet metal 3 formed into a L-shape so that the heat sink 4 has an L-shaped cross section. The L-shaped sheet metal 3 may have a first side 14 and a second side 16. In some embodiments, the first side 14 of the heat sink 4 may have a receiving section 6 on which a lighting module 18 (not shown in FIG. 1) may be mounted. The first side 14 of the L-shaped sheet metal 3 may include a first reference pin 10 and a second reference pin 12. The second reference pin 12 may be deep drawn from the first reference pin 10. The first reference pin 10 may extend at least in part from a first surface 4-1 of the first side 14. The second reference pin 12 may extend at least in part from a second surface 4-2 of the first side 14. On a side of the second reference pin 12, there may be a fiducial 20. Such a fiducial may also be included on a side of the first reference pin 10.

A heat sink, such as the heat sink 4, may be a passive heat exchanger that transfers the heat generated by a lighting module and/or light emitting device, such as an LED unit comprising one or more LED dies, to a gaseous or fluid medium, such as air or a liquid coolant, where heat may be transferred away from the lighting module. A heat sink may thereby allow regulation of the lighting module's temperature at optimal levels. The heat sink may be made from a thermally conductive material, such as a metallic material/sheet metal.

Figure 2:
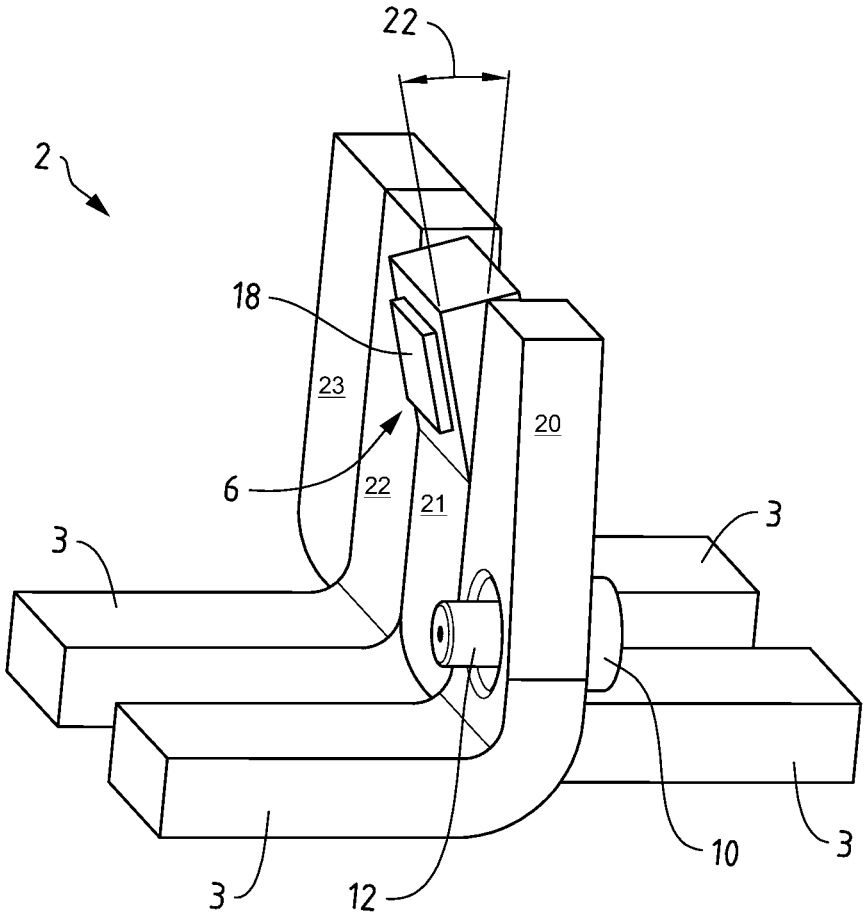
FIG. 2 is a three-dimensional schematic view of an example lighting device.

FIG. 2 is a three-dimensional schematic view of an example lighting device 2. In the example illustrated in FIG. 2, the lighting device 2 includes four L-shaped sheet metals 30, 31, 32 and 33 that are connected to each other and in contact at a lower section of their first sides 14. It can be seen that between the four L-shaped sheet metals 3, an angle is established. An example angle 22 is shown that is established between the second surface of the L-shaped sheet metal 30 and the second surface of the L-shaped sheet metal 31. Further, the second sides 12 of the four L-shaped sheet metals 30, 31, 32 and 33 may alternate in the direction at which they point. One of the L-shaped sheet metals 32 may have a receiving section 6 for receiving a lighting module 18. In FIG. 2, this is the L-shaped sheet metal 31. Further, the L-shaped sheet metals 30, 31, 32 and 33 may differ in certain details from each other.

At least one receiving section 6 configured for receiving the at least one lighting module 18 may be formed in the heat sink. The receiving section 6 may for instance be an opening or a protrusion in the heat sink in or on which a lighting module 18 can be mounted and/or placed. The at least one receiving section 6 may be a pedestal or a cavity. For instance, the at least one lighting module 6 can be arranged or mounted to the heat sink in the receiving section 6. This can insure that the at least one lighting module 6 is accurately positioned on the heat sink. The receiving section 6 may have a form matching to the lighting module 6. The lighting module 6 may be connected with the heat sink, in particular thermally.

A lighting module 18 may for instance be a single LED die or may be or include an LED unit, as described above. An LED unit may include two or three or more LED dies. The lighting module 18 may be configured to emit light towards a light-emitting side. The light-emitting side may represent one or more areas of or around the heat sink, where an object that is to be illuminated may be brought to the light-emitting side for illumination. The lighting module 18 may be intended for use in a lighting application requiring intense bright light, such as an automotive head or back light. Heat may be transferred from the at least one lighting module 18 to the heat sink via a thermal connection established between them. For instance, the lighting module 18 may be placed and/or mounted, such as by soldering and/or gluing it on the heat sink using a thermally conductive material such as a thermal paste, thermal glue or thermal pad.

The at least one first and the at least one second reference pins may be formed into the sheet metal of the heat sink respectively. The at least one first and the at least one second reference pins may be formed directly. The at least one first and the at least one second reference pins may be formed from a thick sheet metal, for example having a thickness of 2 mm minimum. The at least one first and the at least one second reference pins may be formed by double deep drawing them into the sheet metal. The at least one first and the at least one second reference pins may be used to reference and align at least one lighting module, such as an LED module to be mounted to the receiving section, to an optical element, such as related optics (e.g., a reflector or lens).

The at least one first reference pin 10 may protrude (e.g. extend or stick out) from the first surface 4-1 of the heat sink 4 respectively by about 1 mm to 1.5 mm. The same may apply to the at least one second reference pin 12 protruding in the opposite direction of the at least one first reference pin 10 so that it may protrude from the opposite surface (e.g. the second surface 4-2) of the heat sink 4 respectively by about 1 mm to 1.5 mm, to name but a few non-limiting examples. Such a length of protrusion of the at least one first and the at least one second reference pins may be sufficient to enable very accurate referencing alignment to one or more further elements.

An accurate system for positioning the lighting device (e.g., a lamp) in a reflector e.g. of an automotive head lamp may be desirable. The reference pin may for instance provide a locating surface so that, for example, an optical element can be mounted in a pre-defined position, thus aligned or referenced position, in relation to the lighting device. The optical element may be a reflector or a lens, to name but a few non-limiting examples. The optical element may further be mounted to or fixated on the heat sink or the lighting device according to some embodiments.

An example application may be, for example, an automotive lamp according to MACH 3 specification (e.g., an LED lamp design with a low beam and/or high beam lighting source as a respective dual function combined to be mounted to one reflector).

According to another exemplary embodiment, the least one first reference pin and the at least one second reference pin may be arranged concentrically to each other. In this way, optimal alignment of a center of the two reference pins that stick out on both sides of the sheet metal (e.g., a thick (e.g., aluminum) plate) can be achieved.

According to another exemplary embodiment, the at least one first reference pin may have a larger diameter than the least one second reference pin. The at least one second reference pin may be located within a diameter of the at least one first reference pin. It will be understood that a diameter of the at least one second reference pin may be smaller than the diameter of the at least one first reference pin.

According to another exemplary embodiment, the at least one sheet metal of the heat sink may have a thickness of at least 2 mm. The thickness of the sheet metal may be suited to the amount of heat to be transferred (e.g., the sheet metal having a thickness of about 2 mm to 10 mm). The sheet metal thickness may for instance be above 2 mm (e.g., 2.5 or 3 mm). For instance, to reach a needed and optimal situation, such as for thermal management, the sheet metal may be a thick aluminum with a thickness of at least 2 mm.

According to another exemplary embodiment, the at least one first reference pin and/or the at least one second reference pin may include at least one fiducial for enabling placement of at least one lighting module to the heat sink. For instance, a combined manufacturing of the two (e.g., first and second) reference pins with other reference features may also be possible. For instance, one or more fiducials may be provided on a side of the first reference pin, such as for a placement of the lighting module in relation to the one or more fiducials. This may enable inherent referencing of, for example, tool parts during production (e.g., for a placement of a lighting module) so that high positioning accuracy due to both pins may be achieved. In this way, a high speed and cost-effective production of a heat sink and/or a lighting device may be enabled.

According to another exemplary embodiment, the at least one sheet metal may consist of or comprise aluminum, copper, and/or aluminum and/or copper based alloys.

According to another exemplary embodiment, the at least one sheet metal may have an L-shaped cross section having a first side and a second side. The first side of the L-shaped sheet metal may provide a receiving section for the at least one lighting module. The sheet metal may be formed into the L-shape, such as by bending the sheet metal. For instance, the sheet metal may be bent in such a way that the first side is longer than the second side of the L-shaped sheet metal. The L-shaped form of the sheet metal may apply to the sheet metal being viewed in a cross sectional view.

According to another exemplary embodiment, the heat sink may include a plurality of L-shaped sheet metals they may be at least thermally connected to each other. The sheet metal or a plurality of sheet metals may be formed (e.g., bent) into a plurality (e.g., at least two) of such L-shaped sheet metals. The plurality of L-shaped sheet metals may be connected and at least thermally coupled to each other.

According to another exemplary embodiment, the plurality of L-shaped sheet metals may be connected to each other having an angle between their respective second sides allowing the at least one lighting module to be mounted to the heat sink in a tilted position. By connecting the plurality of L-shaped sheet metals, a certain angle between the respective first sides of the L-shaped sheet metals can be arranged.

According to another exemplary embodiment, the at least one receiving section for the at least one lighting module may be angled (e.g., tilted) in relation to another L-shaped sheet metal of the plurality of sheet metals of the heat sink. In this way, for example, a certain direction in which light is emitted by the lighting module can be achieved.

According to another exemplary embodiment, one L-shaped sheet metal of the plurality of L-shaped sheet metals may include the at least one first reference pin and the at least one second reference pin. Another L-shaped sheet metal of the plurality of L-shaped sheet metals may include the at least one receiving section for the at least one lighting module. Further, one or more of the plurality of L-shaped sheet metals forming the heat sink may include a combination of a first reference pin and a second reference pin, as described above.

According to another exemplary embodiment, the heat sink includes a plurality of L-shaped sheet metals that are connected to each other, at least in part, where the respective first sides of the L-shaped sheet metals collide with each other. For the assembly of a dual function LED module (e.g., for head lighting application in automotive appliances), two similar and/or identical heat sinks (e.g., sheet metals or sheet metal parts) may be used, where the two sheet metals are connected (e.g., joined), such as to host the lighting modules (e.g., LEDs) for two functions (e.g., low beam and high beam). Further, the plurality of L-shaped sheet metals may be connected to each other via their respective first and/or second sides, or parts thereof. The connection may be a gluing, welding and/or riveting, to name but a few non-limiting examples.

According to another exemplary embodiment, the respective second sides of the plurality of L-shaped sheet metals may alternate the direction in which the respective second sides of the L-shaped sheet metals protrude. The plurality of L-shaped sheet metals may be connected to each other in such a way that the respective second sides of the plurality of L-shaped sheet metals alternate in the longitudinal direction in which they extend. One or more of the second sides may enable fixation of a corresponding lighting device comprising the plurality of L-shaped sheet metals connected to each other to a mounting section provided, for example, by an automotive head lamp.

Figure 4:
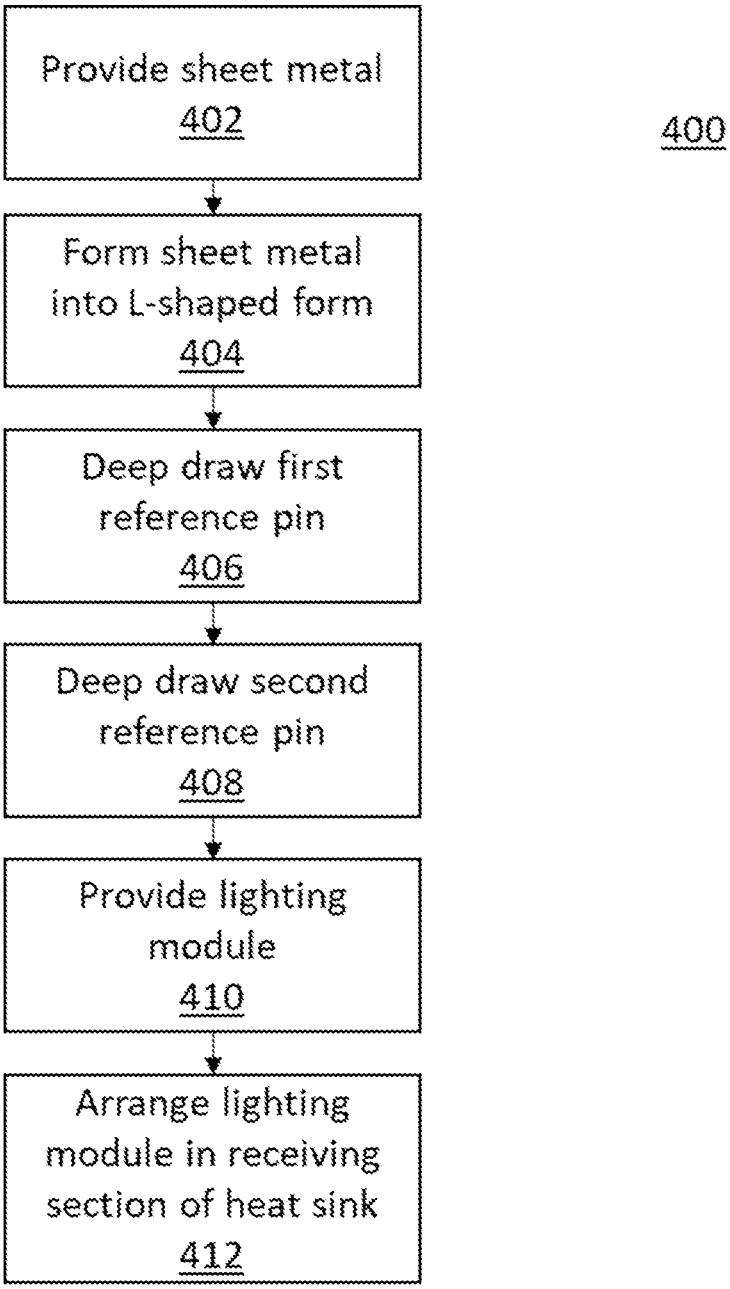
FIG. 4 is a flow diagram of an example method of manufacturing a lighting device.

FIG. 4 is a flow diagram of an example method 400 of manufacturing a lighting device. In the example illustrated in FIG. 4, at least one sheet metal is provided (402). In embodiments, the at least one sheet metal may be the sheet metal 3 of FIG. 1. The at least one sheet metal may be formed into an L-shaped form (404). At least one first reference pin may be deep drawn into the sheet metal (406). In embodiments, the at least one first reference pin may be the reference pin 10. The at least one first reference pin may be deep drawn from the sheet metal on the first surface 4-1 At least one second reference pin may be deep drawn into the sheet metal (408). In embodiments, the at least one second reference pin may be the reference pin 12. The at least one second reference pin may be deep drawn from a top side (see 24 in FIG. 1) of the at least one first reference pin 10 in an opposite direction to the direction in which the at least one first reference 10 is deep drawn. At least one lighting module (e.g., lighting module 18 of FIG. 2) may be provided (410). The lighting module may be arranged in a receiving section of the heat sink formed by at least one of the L-shaped sheet metals (412). As mentioned above, at least one further sheet metal may be provided for forming another sheet metal to be connected with the sheet metal to form the heat sink.

While the flow diagram of FIG. 4 shows steps performed in a particular order, one of ordinary skill in the art will understand that the steps may be performed in different orders. For example, the at least one first and/or second reference pins may be deep drawn into the sheet metal before the sheet metal is formed into the L-shaped form.

This may be referred to as double deep drawing. In embodiments, the at least one first reference pin may be deep drawn by a direct forming of a thin walled pin from the sheet metal, which may be a thick metal plate. The at least one second metal pin may be deep drawn from the part forming the top side of the first reference pin in the opposite direction of the first reference pin. In this way, both reference pins can be very accurately aligned in relation to their position on the heat sink, for example, so that customer and/or lighting application specification for a light source with respect to accuracy can be met. Accuracy of positioning with a tolerance of 50 μm or less can be achieved. Further, this may enable design of a more cost-effective solution for such a heat sink by using, for example, a thick sheet metal as a base material. By deep drawing the first and second reference pins, there may be no need for joining technologies, such as welding or loose alignment features.

In embodiments, the heat sink may be made by a forming, stamping, punching and/or trimming process from a thermally conductive material, such as a metallic material. The first and second reference pins may be formed into the sheet metal by deep drawing them into the heat sink, for example in the same manufacturing process or a subsequent manufacturing process following the forming, stamping, punching and/or trimming process. This may at least apply to the first reference pin having a larger diameter than the second reference pin.

Figure 3A:
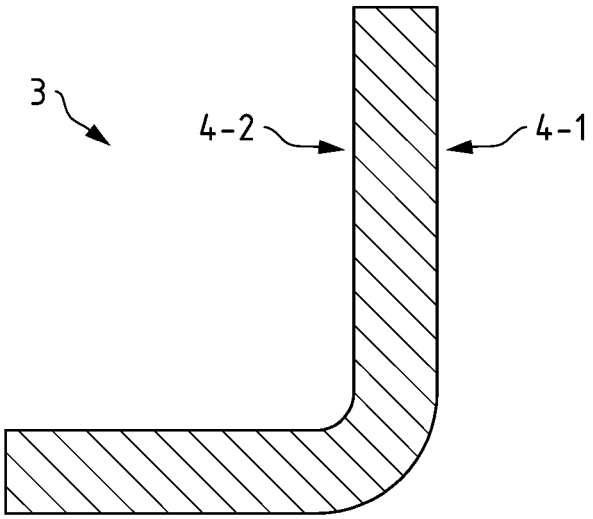
FIGS. 3*a*, 3*b* and 3*c* are cross-sectional schematic views of a lighting device at different stages in a method of manufacture.
Figure 3B:
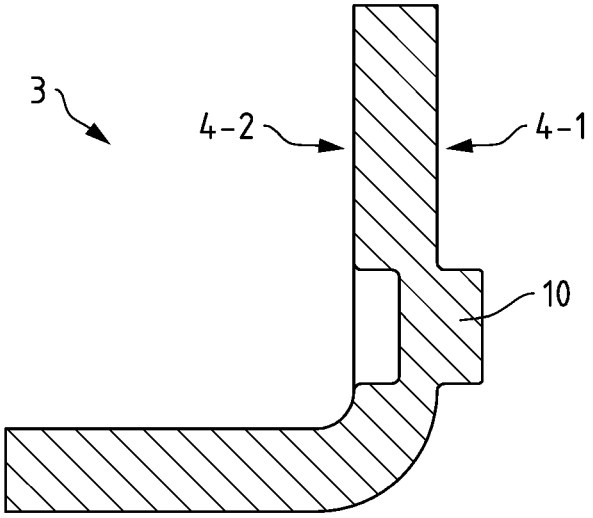
Figure 3C:
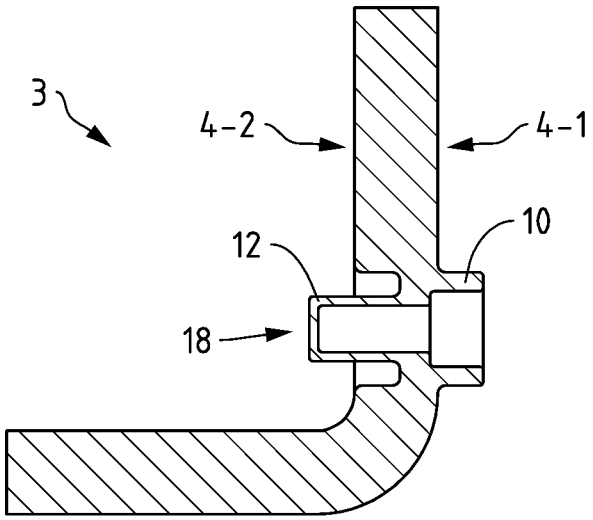

FIGS. 3*a*, 3*b* and 3*c* are cross-sectional schematic views of a lighting device at different stages in a method of manufacture.

In FIG. 3*a*, a sheet metal 3 is formed into a form having an L-shaped cross section. The sheet metal 3 defines a first surface 4-1 and a second surface 4-2. This may be the starting situation enabling a first reference pin 10 and a second reference pin 12 to be deep drawn into the sheet metal 3.

In FIG. 3*b*, a first reference pin 10 having a larger diameter compared to a subsequently deep drawn second reference pin 12 (see FIG. 3*c*) is deep drawn from the sheet metal 3 or a part it on the first surface 4-1 of the sheet metal 3. This may be done by a one side cut and embossing the first reference pin 10.

In FIG. 3*c*, a second reference pin 12 is deep drawn. The second reference pin 12 may have a smaller diameter than the first reference pin 10. The second reference pin 12 may be deep drawn from the top side 24 of the first reference pin 10. In comparison to the first reference pin 10, the second reference pin 12 may be deep drawn in the opposite direction.

The second reference pin 12 may stick out beyond the second surface 4-2 of the sheet metal 3. The first reference pin 10 may stick out beyond the first surface 4-1 of the sheet metal 3. Eventually, the larger diameter first reference pin 10 may extend beyond of the first surface 4-1 of the sheet metal 3 by about 1 mm to 1.5 mm. Correspondingly, the lower diameter second reference pin 12 may extend beyond of the second surface 4-2 of the sheet metal 3.

In the embodiment illustrated in FIGS. 3*b* and 3*c*, both reference pins 10 and 12 are concentric. Both reference pins 10 and 12 may be used, for example, to reference a lighting module 18 (e.g., an LED module) mounted to the receiving section 6 to the related optics, such as a reflector of an automotive head lamp, to name but one non-limiting example.

In embodiments, a pick-and-place robot using a placement head may be used for mounting the at least one lighting module to the heat sink. This may be repeated (in sequence or in parallel) for other lighting modules. The placement head may have easy access to the receiving section or sections for arranging the lighting module or modules. After the lighting module or modules is/are mounted to the sheet metal or metals (e.g., as described above), the sheet metals may be joined by establishing a thermal connection between the sheet metals. The pick-and-place robot may utilize the one or more fiducials for the alignment of the placement of the lighting module or modules.

In embodiments, for a manufacturing of the first and the second reference pins, deep drawing in a single direction may be done in a more efficient matter in contrast to deep drawing in several directions. Also, deep drawing in a single direction may enable to deep draw a plurality (e.g., at least two) of reference pins simultaneously (e.g., in a single manufacturing step). Thus, for manufacturing of the first and the second reference pins, the first reference pin or more than one of such first reference pins may be deep drawn in a first (e.g., single) direction. Then, in a subsequent manufacturing step, the second reference pin or more than one of such second reference pins may be deep drawn in a second (e.g., single) direction opposite to the first direction.

In embodiments, as mentioned above, a sheet metal may be formed in such a way that it has an L-shaped cross section. In embodiments, this may be done prior or subsequent to the forming of the at least one first reference pin and the at least one second reference pin. At least one further sheet metal may be provided and formed in such a way that the at least one further sheet metal has an L-shaped cross section. The sheet metal and the at least one further sheet metal may be thermally coupled and/or connected to each other. In embodiments, the sheet metal may be formed into the L-shaped form by bending and the sheet metal and the at least one other sheet metal may be connected by gluing, welding and/or riveting them together (e.g., where the sheet metal and the further sheet metal may be connected in such a way that a certain or pre-defined angle is established between the respective second sides of the L-shaped sheet metal and the L-shaped further sheet metal).

According to another exemplary embodiment, at least one fiducial may be formed into a top surface of the at least one first reference pin and/or the at least one second reference pin. The fiducial may be formed into the top surface of the first and/or second reference pin by deep drawing it into the top surface. The fiducial may be formed into the top surface of a respective reference pin in the same deep drawing process forming the respective reference pin into the sheet metal.

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A heat sink configured for mounting a lighting device thereupon, the heat sink comprising:

at least one sheet metal having a first surface and a second surface opposite the first surface;

at least one first reference pin deep drawn from the at least one first sheet metal so as to extend outward at least in part from the first surface; and at least one second reference pin deep drawn from the at least one first sheet metal so as to extend outward at least in part, from the second surface by a length that references the lighting device to a corresponding optical component when the lighting device is mounted on the heat sink, and located within a diameter of, and concentrically with, the at least one first reference pin, the diameter of the at least one first reference pin being larger than a diameter of the at least one second reference pin.

2. The heat sink of claim 1, wherein the at least one sheet metal has an L-shaped cross section comprising a first side and a second side.

3. The heat sink of claim 2, wherein the heat sink comprises a plurality of L-shaped sheet metals that are at least thermally coupled to each other.

4. The heat sink of claim 3, wherein an angle between the respective second sides of the plurality of L-shaped sheet metals allows at least one lighting module to be mounted to the heat sink in a tilted position.

5. The heat sink of claim 3, wherein one L-shaped sheet metal of the plurality of L-shaped sheet metals comprises the at least one first reference pin and the at least one second reference pin, and another L-shaped sheet metal of the plurality of L-shaped sheet metals comprises the at least one receiving section for the at least one lighting module.

6. The heat sink of claim 2, wherein the first side of the L-shaped sheet metal provides a receiving section for at least one lighting module.

7. The heat sink as of claim 1, wherein at least one of the at least one first reference pin or the at least one second reference pin comprise at least one fiducial.

8. The heat sink of claim 7, wherein the at least one fiducial is for placement of at least one lighting module on the heat sink.

9. The heat sink of claim 1, wherein the at least one first reference pin and the at least one second reference pin are configured to reference the heat sink to the at least one optical element.

10. The heat sink of claim 1, wherein the first and second reference pins are drawn from at least one sheet metal of the heat sink having a thickness of at least 2 mm.

11. The heat sink of claim 1, wherein the at least one sheet metal comprises aluminium.

12. A lighting device comprising:

at least one heat sink comprising:

at least one sheet metal having a first surface and a second surface opposite the first surface, at least one first reference pin drawn from the at least one sheet metal and extending outward at least in part from the first surface, and at least one second reference pin drawn from the at least one sheet metal and extending outward at least in part from the second surface and located within a diameter of, and concentrically with, the at least one first reference pin, the diameter of the at least one first reference pin being larger than a diameter of the at least one second reference pin; and at least one lighting module mounted to at least one receiving section of the at least one heat sink;

wherein at least one of the first and second reference pins extends from the second surface by a length that aligns the at least one lighting module to a corresponding optical component when the at least one lighting module is mounted to the at least one receiving section.

13. The lighting device of claim 12, wherein the heat sink comprises a plurality of L-shaped sheet metals that are thermally coupled to each other, at least in part, and wherein the respective first sides of the L-shaped sheet metals collide with each other.

14. The lighting device of claim 13, wherein the respective second sides of the plurality of L-shaped sheet metals alternate in a direction in which the respective second sides of the L-shaped sheet metals protrude.

15. A method of manufacturing a lighting device, the method comprising:

providing at least one sheet metal to form a heat sink;

deep drawing at least one first reference pin into the at least one sheet metal in a first direction, the at least one first reference pin drawn from the at least one sheet metal on a first surface such that the at least one first reference pin extends outward from the first surface by a length that references at least one lighting module to at least one corresponding optical component;

deep drawing at least one second reference pin into the at least one sheet metal in a second direction opposite the first direction, the at least one second reference pin deep drawn from a top side of the at least one first reference pin such that the at least one second reference pin extends outward from the second surface by a length that references at least one lighting module to the at least one corresponding optical component;

providing the at least one lighting module; and arranging the at least one lighting module in at least one receiving section of the heat sink, including aligning the at least one lighting module with the at least one corresponding optical component by referencing at least one of the length of the first reference pin and the length of the second reference pin.

16. The method as claimed in claim 15, further comprising:

forming the at least one sheet metal to have an L-shaped cross section;

providing at least one further sheet metal;

forming the at least one further sheet metal have an L-shaped cross section; and thermally coupling the at least one sheet metal and the at least one further sheet metal to form the heat sink.

* * * * *